US008956024B2

(12) United States Patent
Berg et al.

(10) Patent No.: US 8,956,024 B2
(45) Date of Patent: Feb. 17, 2015

(54) DOCK LIGHTING GROUPS

(76) Inventors: Carl Berg, St. Joseph, MN (US); John Holb, Eden Prairie, MN (US); Thomas V. Turcotte, Chanhassen, MN (US)

( * ) Notice: Subject to any disclaimer, the term of this patent is extended or adjusted under 35 U.S.C. 154(b) by 498 days.

(21) Appl. No.: 13/344,640

(22) Filed: Jan. 6, 2012

(65) Prior Publication Data

US 2013/0176712 A1 Jul. 11, 2013

(51) Int. Cl.

| | |
|---|---|
| ***B63B 45/02*** | (2006.01) |
| ***G08B 21/00*** | (2006.01) |
| ***F21S 8/00*** | (2006.01) |

(52) U.S. Cl.
USPC ..... 362/477; 362/145; 362/183; 340/686.6

(58) Field of Classification Search
CPC ..... B63B 45/04; B63B 45/02; B63B 45/00; B63B 2725/00; F21W 2101/04
USPC ..... 362/477, 145, 183
See application file for complete search history.

(56) References Cited

U.S. PATENT DOCUMENTS

| | | | | |
|---|---|---|---|---|
| 4,873,600 | A | 10/1989 | Vogele | |
| 4,903,243 | A | 2/1990 | Turner, Jr. | |
| 6,095,074 | A | 8/2000 | Reinhardt | |
| 7,452,106 | B2 | 11/2008 | Tseng | |
| 8,672,502 | B2 * | 3/2014 | Hartman | 362/145 |
| 2001/0050619 | A1 | 12/2001 | Wiggerman et al. | |
| 2005/0174762 | A1 | 8/2005 | Fogerlie | |
| 2007/0251441 | A1 | 11/2007 | Herndon | |
| 2008/0089057 | A1 * | 4/2008 | Murphy | 362/145 |
| 2012/0326882 | A1 * | 12/2012 | Behm | 340/686.6 |

OTHER PUBLICATIONS

"Dock Accessories (Lights, Ladders, Boarding Handles, Gull Sweep)", <http://marineengineparts.com/shopsite_sc/store/html/page309.html#629>, accessed Oct. 20, 2011 (4 pp.).

* cited by examiner

*Primary Examiner* — Joseph L Williams
(74) *Attorney, Agent, or Firm* — Brooks, Cameron & Huebsch, PLLC

(57) ABSTRACT

The present disclosure provides a dock lighting system. One or more embodiments include a power source attached to a first dock section, a first modular lighting group attached to the first dock section, wherein the first modular lighting group is electrically connected to the power source, and a second modular lighting group attached to a second dock section, wherein the second modular lighting group is electrically connected to the first modular lighting group.

20 Claims, 4 Drawing Sheets

DOCK LIGHTING GROUPS

TECHNICAL FIELD

The present disclosure relates to a dock lighting system.

BACKGROUND

A dock can provide a user with a way to access a body of water and/or a watercraft stored on the body of water. For example, a dock can provide a user with a recreational platform to fish and/or swim from. Alternatively, and/or in addition, a dock can provide a user access to a watercraft (e.g., boat, plane, etc.) that can be moored at the dock and/or stored on a boat lift.

Docks, however, can present hazards when limited lighting is available due to a time of day and/or weather, for example. Limited lighting may make it difficult for a user to see an edge of the dock and/or an obstacle on the dock, which can result in an injury to the user. Alternatively, and/or in addition, nighttime can present an opportunity for a thief to steal items left on and/or in areas that surround the dock (e.g., watercraft).

DETAILED DESCRIPTION

Figure 1A:
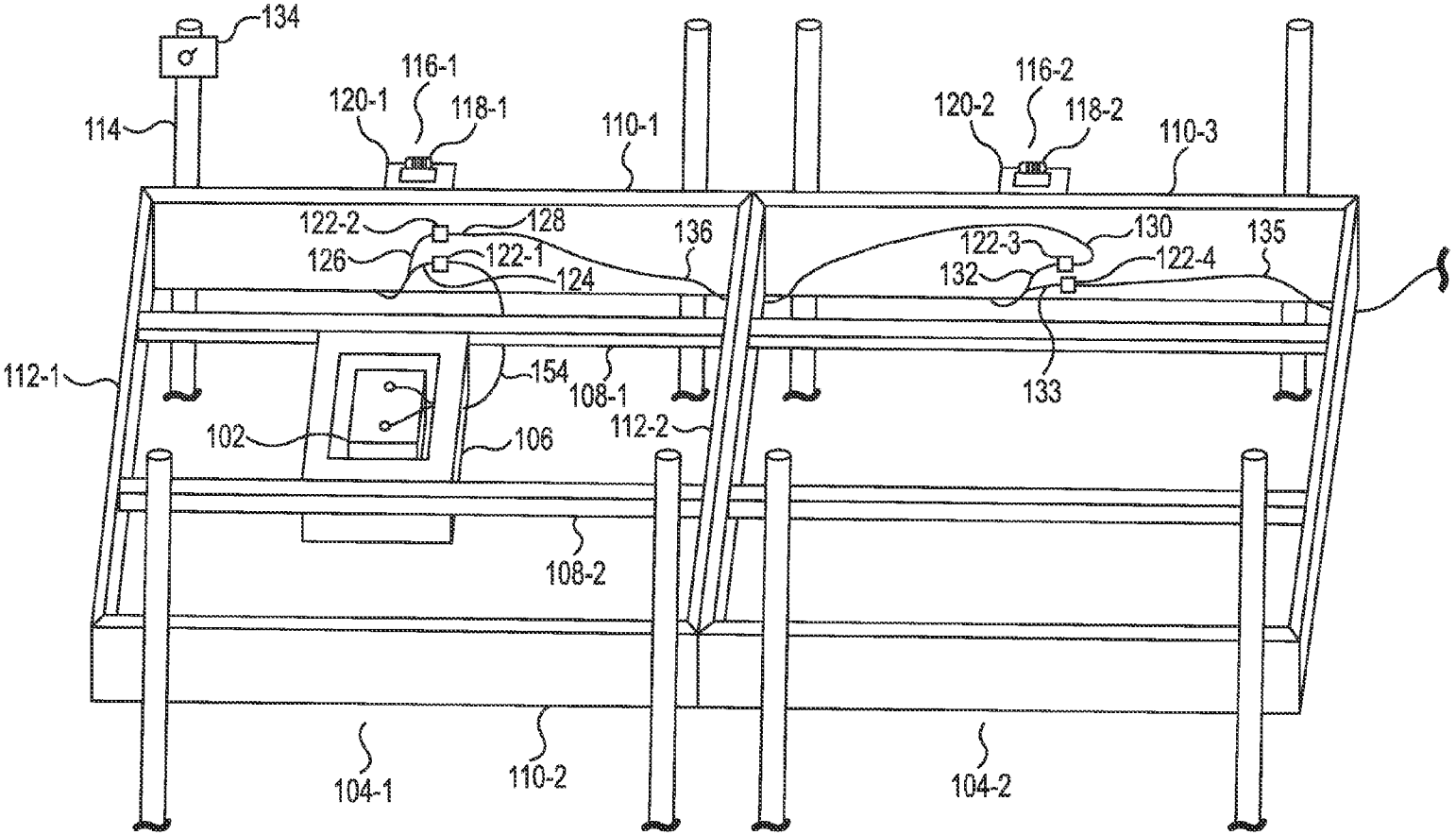
FIG. 1A illustrates a modular dock lighting system according to one or more embodiments of the present disclosure.

The present disclosure provides a dock lighting system. One or more embodiments include a power source attached to a first dock section, a first modular lighting group attached to the first dock section, wherein the first modular lighting group is electrically connected to the power source, and a second modular lighting group attached to a second dock section, wherein the second modular lighting group is electrically connected to the first modular lighting group.

Some embodiments of the present disclosure can provide a modular dock lighting system that allows for expansion of the lighting system based on various sizes of docks. For example, if a section of dock is added to an existing dock, the lighting system can be expanded accordingly by installing a modular lighting group on the added section of dock or manufacturing a dock section with a modular lighting group provided thereon.

Some embodiments of the present disclosure can provide increased lighting options for a dock. In an example, the modular design of the dock lighting system can allow for an increased and/or decreased density of lighting directed on the dock and/or areas surrounding the dock by allowing for more or less lights to be installed and/or different types of lights to be installed in a respective modular lighting group on a dock section.

Some embodiments of the present disclosure can provide dock lighting options that are unobtrusive. For example, a power source used for powering the lighting system can be located under decking of the dock, providing for a deck surface of the dock that is free of obstructions. Alternatively, and/or in addition, the lights can be mounted at a location that does not extend over a surface of the decking of the dock. For instance, the lights can be mounted to an exterior frame member of the dock to provide an unobstructed decking surface, while still directing light over the decking of the dock.

In the following detailed description of the present disclosure, reference is made to the accompanying drawings that form a part hereof, and in which is shown by way of illustration how one or more embodiments of the disclosure may be practiced. These embodiments are described in sufficient detail to enable those of ordinary skill in the art to practice the embodiments of this disclosure, and it is to be understood that other embodiments may be utilized and that process, electrical, and/or structural changes may be made without departing from the scope of the present disclosure.

The figures herein follow a numbering convention in which the first digit or digits correspond to the drawing figure number and the remaining digits identify an element or component in the drawing. Similar elements or components between different figures may be identified by the use of similar digits. For example, 102 may reference element "02" in FIG. 1A, and a similar element may be referenced as 202 in FIG. 2.

As will be appreciated, elements shown in the various embodiments herein can be added, exchanged, and/or eliminated so as to provide a number of additional embodiments of the present disclosure. In addition, as will be appreciated, the proportion and the relative scale of the elements provided in the figures are intended to illustrate the embodiments of the present disclosure, and should not be taken in a limiting sense.

As used herein, "a" or "a number of" something can refer to one or more such things. For example, "a number of differences" can refer to one or more differences.

FIG. 1A illustrates a modular dock lighting system according to one or more embodiments of the present disclosure. The modular dock lighting system can be attached to a dock. The dock can include a first dock section 104-1 and a second dock section 104-2, although examples are not so limited. In some embodiments, the modular dock lighting system can be used to illuminate features of the dock (e.g., decking on respective dock sections, dock posts, a bench, and/or flag attached to dock) and/or areas that surround the dock (e.g., boat lift and/or shoreline), for example.

The modular dock lighting system can include a power source 102 attached to a first dock section 104-1. The power source 102 can be a battery (e.g., 12 volt deep cycle battery). In some embodiments, the power source 102 can be housed in a case 106. The power source 102 and/or case 106 can be attached to a frame member of the dock. For example, the power source 102 and/or case 106 can be attached to a first frame member 108-1 and/or a second frame member 108-2; a first exterior frame member 110-1 and/or second exterior frame member 110-2; a first end frame member 112-1 and/or second end frame member 112-2; and/or a dock post 114.

In an example, the case 106 can be attached to a frame member through welding and/or fasteners. Alternatively, and/or in addition, the power source can be attached to a frame member through straps and/or a mount, for example.

In some embodiments, the modular dock lighting system can include a first modular lighting group 116-1 attached to the first dock section 104-1. The first modular lighting group 116-1 can include a light 118-1. In an example, the light 118-1 can be a light emitting diode (LED) and/or an incandescent light. LEDs can have a reduced energy requirement as opposed to other lighting sources (e.g., incandescent lights), which can reduce energy requirements associated with the operation of the modular dock lighting system.

The light 118-1 can be attached to an exterior frame member 110-1. Alternatively, and/or in addition, the light 118-1 can be attached to a mount 120-1 that is attached to an exterior frame member of the dock 110-1.

The first modular lighting group 116-1 can be electrically connected to the power source 102. In some embodiments, a power lead 154 can be connected to the power source 102. The power lead 154 can be connected to a first lead of the first modular lighting group 124 by a first connector 122-1 to provide power to the light 118-1.

In an example, connecting the power lead 154 to the first lead of the first modular lighting group 124 with a connector can allow for disconnection of the power lead 154 from the first lead of the first modular lighting group 124. For instance, the power lead 154 can be disconnected from the first lead of the first modular lighting group 124 for service and/or installation, in an example.

The electrical connector 122-1 can have a waterproof electrical connector with a male and female end, for example. A waterproof connection can provide protection from water and dust, for example, which can provide increased reliability and/or increased service life of the modular dock lighting system.

Alternatively, and/or in addition, the first modular lighting group 116-1 can be electrically connected to the power source 102 without an electrical connector between the power source 102 and the first modular lighting group 116-1. In an example, the first modular lighting group 116-1 and the power source 102 can be formed of a continuous wire. By using a continuous wire, a cost of producing the modular dock lighting system can be reduced. Alternatively, and/or in addition, the modular dock lighting system can provide increased reliability and/or increased service life as opposed to when using a connector which can fail.

In some embodiments, the modular dock lighting system can include a second modular lighting group 116-2 attached to the second dock section 104-2. The second modular lighting group 116-2 can include a light 118-2. The light 118-2 can be attached to an exterior frame member 110-3. Alternatively, and/or in addition, the light 118-2 can be attached to a mount 120-2 that is attached to an exterior frame member of the dock 110-3.

The second modular lighting group 116-2 can be electrically connected to the first modular lighting group 116-1 via an expansion lead 136. In an example, the second connector 122-2 can electrically connect a second electrical lead of the first modular lighting group 126 to a first end of an expansion lead 128. The second end of the expansion lead 130 can be connected to a first lead of the second modular lighting group 132 with a third connector 122-3 to provide power to the light 118-2. As discussed herein, use of connectors can allow for disconnection of the various parts of the modular dock lighting system for service and/or installation, for example.

Alternatively, and/or in addition, the second lead of the first modular lighting group 126 and the first lead of the second modular lighting group 132 can be connected without use of a connector. In an example, the second lead of the first modular lighting group 126 and the first lead of the second modular lighting group 132 can be formed of a continuous wire. As discussed herein, by using a continuous wire, a cost of producing the modular dock lighting system can be reduced. Alternatively, and/or in addition, the modular dock lighting system can provide increased reliability and/or increased service life as opposed to when using a connector which can fail.

The number of modular lighting groups can be expanded through a fourth connector 122-4. In an example, the fourth connector 122-4 can electrically connect a second electrical lead of the second modular lighting group 133 to an expansion lead 135, which can be electrically connected to another (e.g., a third) modular lighting group.

In some embodiments, the modular dock lighting system can include a switch 134 configured to complete an electrical connection between the power source 102, the first modular lighting group 116-1, and/or the second modular lighting group 116-2. The switch 134 can be mounted to a dock post 114, a post and/or structure located on shore, and/or to a frame rail beneath decking of the dock, accessible through an access hatch in the decking of the dock, among other suitable locations.

The switch 134 can be a wired switch and/or a wireless switch. In an example, the wired switch can be connected to the power source 102 and/or the wired switch can be connected between the power source 102 and the first modular lighting group 116-1 and/or the second modular lighting group 116-2.

Alternatively and/or in addition, the wireless switch can include a receiver connected to the power source 102 and/or between the power source 102 and the first modular lighting group 116-1 and/or the second modular lighting group 116-2, for example. The receiver can be configured to receive a signal from a transmitter. Upon reception of the signal, the receiver can be configured to cause an electrical connection to be completed between the power source 102 and the first modular lighting group 116-1 and/or the second modular lighting group 116-2.

The switch 134 can control the modular lighting groups and/or lights separately and/or together. For example, the first modular lighting group 116-1 can be turned off by the switch 143, while the second modular lighting group 116-2 can be turned on.

In some embodiments, the switch 134 can be a manual switch that can be activated by a user. Alternatively, and/or in addition, the switch 134 can be a motion switch. The motion switch can include a motion sensor. Upon detection of motion, the motion switch can cause an electrical connection between the power source 102 and the first modular lighting group 116-1 and/or the second modular lighting group 116-2 to be completed.

Alternatively, and/or in addition, the switch 134 can be an optical switch. The optical switch can include an optical sensor configured to detect light. The optical switch can be configured to cause an electrical connection to be completed between the power source 102, the first modular lighting group 116-1, and/or the second modular lighting group 116-2 when light entering the optical sensor reaches a threshold (e.g., sun is setting, cloudy, foggy).

Figure 1B:
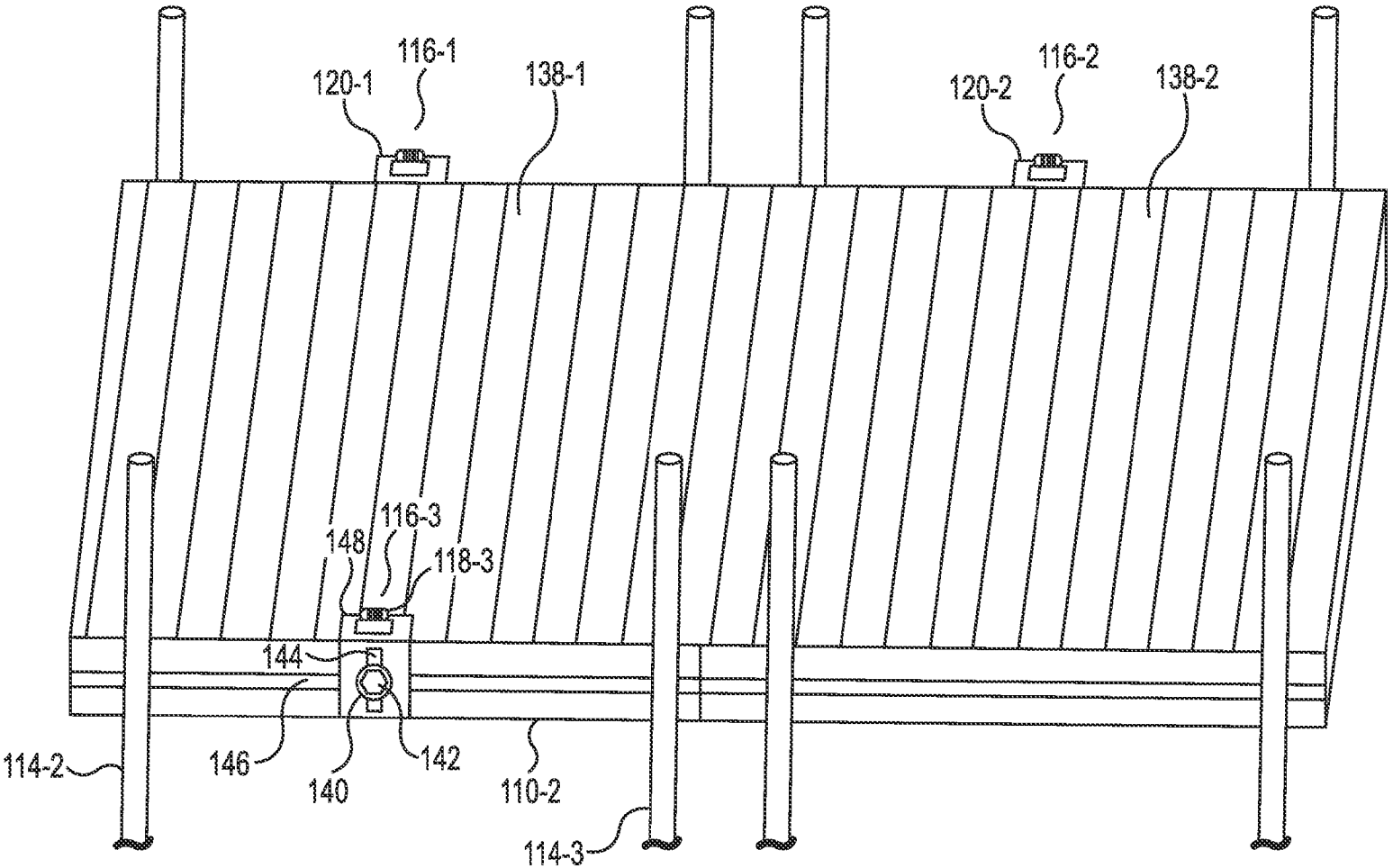
FIG. 1B illustrates a modular dock lighting system and associated decking of a first and second section of the dock according to one or more embodiments of the present disclosure.

FIG. 1B illustrates a modular dock lighting system and associated decking of a first and second section of the dock according to one or more embodiments of the present disclosure. The modular dock lighting system includes a first modular lighting group 116-1 that includes a mount 120-1, second modular lighting group 116-2 that includes a mount 120-2, and third modular lighting group 116-3 that includes an adjustable mount 148. The first modular lighting group 116-1, second modular lighting group 116-2, and third modular lighting group 116-3 can be configured to project light over decking of the first dock section 138-1 and decking of the second dock section 138-2. In some embodiments, a modular lighting group can be mounted to a dock post (e.g., 114-2, 114-3). In some embodiments, a modular lighting group can be mounted over a decking of a dock section. In an example, a third modular lighting group 116-3 can be mounted over a decking of the first dock section 138-1.

The third modular lighting group 116-3 can include a light 118-3. The light 118-3 can be attached to an exterior frame member 110-2. Alternatively, and/or in addition, the light 118-3 can be attached to an adjustable mount 148 that is attached to an exterior frame member of the dock 110-2.

In an example, the adjustable mount 148 can be provided by an angle stock (e.g., angle metal stock), which can be fastened (e.g., bolted, riveted, welded, and/or attached in another manner to an exterior frame member 110-2) and can be configured to mount the light 118-3 over the decking of the first dock section 138-1. For instance, a first portion of the adjustable mount 148 can be fastened to the exterior frame member 110-2. A second portion of the adjustable mount 148, which the light 118-3 can be attached to, can be placed over the decking of the first dock section 138-1.

Alternatively, and/or in addition, the second portion of the adjustable mount 148 that the light 118-3 is attached to can be configured to extend away from the decking of the first dock section 138-1, such that the adjustable mount 148 does not extend over the decking of the first dock section 138-1. In an example, the light 118-3 can be attached to the second portion of the adjustable mount 148 such that the light 118-3 projects light over the decking of the first dock section 138-1. For instance, an LED and/or incandescent lamp in the light can be positioned to illuminate the decking of the first dock section 138-1. This can allow the decking of the first dock section 138-1 to be illuminated, while allowing for an unobstructed surface of the decking of the first dock section 138-1.

In some embodiments, the second portion of the adjustable mount 148 that the light 118-3 is attached to can be placed in contact with the decking of the first dock section 138-1. By causing the second portion of the adjustable mount 148 to contact the decking of the first dock section 138-1, a downward pressure can be exerted on the decking of the first dock section 138-1, thus keeping the decking of the first dock section in place during high winds and/or high water. Alternatively, and/or in addition, the second portion of the adjustable mount 148 can be placed over the decking of the first dock section 138-1, but not in contact with the decking of the first dock section 138-1.

In some embodiments, each light 118-3 in the third modular lighting group 116-3 can be attached to an adjustable mount 148 that is attached to an exterior frame member of the dock 110-2. In an example, the adjustable mount 148 can include a slot 144 through which a fastener 142 can extend through. For instance, fastener 142 can be a bolt that extends through the slot 144 in the adjustable mount 148 into a channel 146. Channel 146 can be configured to hold a nut that the bolt can screw into. In some embodiments, a washer 140 can be placed between the fastener 142 and the adjustable mount 148 to prevent marring of the adjustable mount 148 and or deformation of the adjustable mount 148 from a force being applied to the fastener 142.

In some embodiments, the adjustable mount 148 can be configured to provide for a vertical adjustment and/or a lateral adjustment. The vertical adjustment can be provided through the slot 144 by allowing the adjustable mount to slide vertically in relation to the fastener 142, in an example. For instance, by loosening the fastener 142 (e.g., unscrewing the bolt from the nut located in the channel 146) the adjustable mount 148 can be slid up the length of the slot 144 and/or slid down the length of the slot 144 and/or until the adjustable mount 148 contacts the decking of the first dock section 138-1.

The lateral adjustment can be provided through the channel 146 by allowing the adjustable mount to slide laterally along the channel 146, in an example. For instance, by loosening the fastener, the adjustable mount 148 can be slid laterally the length of the channel 146.

Accordingly, the adjustable mount 148 can be adjusted laterally and/or vertically to a desired position. Upon reaching the desired position, the fastener 142 can be tightened (e.g., the bolt can be screwed into the nut) to lock the adjustable mount 148 into place.

Figure 2:
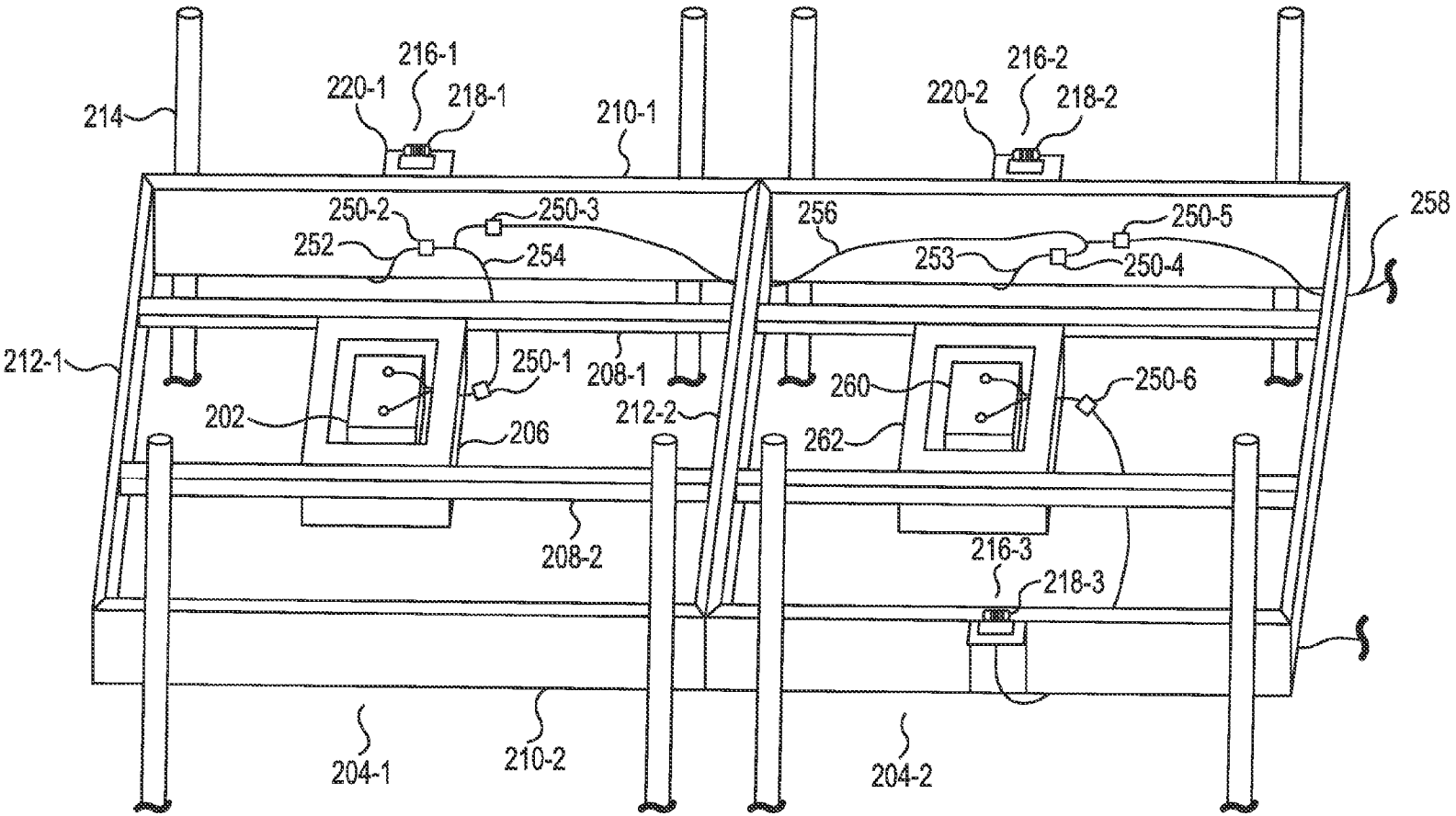
FIG. 2 illustrates a modular dock lighting system that includes two power sources according to one or more embodiments of the present disclosure.

FIG. 2 illustrates a modular dock lighting system that includes two power sources according to one or more embodiments of the present disclosure. In a manner analogous to that discussed in relation to FIG. 1A, the modular dock lighting system can include a first dock section 204-1 and a second dock section 204-2.

In some embodiments, the modular dock lighting system can include a power source 202 with a first electrical connection 250-1. In an example, the power source can be configured to attach to the first dock section 204-1 in a manner such as that discussed in relation to FIG. 1A.

In some embodiments, the power source 202 can be configured to attach at a location within the first dock section 204-1. For example, the power source 202 can be configured to attach at a position located beneath decking of the first dock section 204-1. Attaching the power source 202 beneath decking of the dock can allow for the surface of the decking of the dock to be free from obstructions, which can be run into and/or tripped over by a user of the dock, for example.

In some embodiments, the modular dock lighting system can include a case 206 configured to contain the power source 202 (e.g., battery). The case 206 can be attached to the dock in a manner such as that discussed in relation to FIG. 1A (e.g., to a frame member of the dock section).

In some embodiments, a depth of the case 206 can be less than a depth of a frame member of the dock. For example, a depth of the case 206 can be less than a depth of a first frame member 208-1 and/or a second frame member 208-2; a first exterior frame member 210-1 and/or second exterior frame member 210-2; a first end frame member 212-1 and/or second end frame member 212-2.

Alternatively, and/or in addition, the depth of the case 206 can be less than a depth of a frame member of the dock with the greatest depth. For example, the depth of the case 206 can be less than a depth of the frame of the dock, such that the case 206 does not extend below the frame of the dock. This can help to provide a visual indication to a user when setting the dock in place that the case 206 is not touching the water beneath the dock.

In an example, when the case 206 is attached to an exterior frame rail (e.g., 210-1, 210-2) that has the greatest depth of the frame members of the dock, and the case 206 does not extend below the exterior frame rail, a user can visually verify that the case is not touching the water beneath the dock. For instance, when a user sets the dock in place, the user can verify that the case 206 is out of the water by visually verifying that the exterior frame rail is out of the water, because the case 206 does not extend below the exterior frame rail.

Alternatively, and/or in addition, the depth of the case 206 can be less than a frame member to which the case 206 is attached. Ensuring that the depth of the case 206 is less than the frame member to which the case 206 is attached can allow for an unobstructed area beneath the dock. For example, when maintenance activities are performed by a user beneath the dock and/or users are swimming beneath the dock, ensuring that the depth of the case 206 is less than the frame member to which the case 206 is attached can make it less likely that a user will contact the case 206 unintentionally.

The case 206 can be waterproof, in some embodiments. The case 206 can be constructed of a waterproof material and/or have waterproof seams along the bottom, sides, and/or top of the case 206. For example, the case can be constructed of fiberglass, plastic, and/or metal (e.g., aluminum) and/or seems can be welded and/or caulked with a waterproofing material (e.g., silicone).

To allow ready access to the power source 202, the case 206 can have an access opening that allows for access and/or removal of the power source 202. The access opening can be located on the bottom, side, and/or top of the case 206. In an example, the case 206 can be configured to accept a lid that encloses the case 206 to protect the power source from the elements (e.g., sun, rain, water, snow). Accordingly, a waterproof seal can be placed around the access opening and/or around a perimeter of the lid to allow for waterproofing of the case 206.

In some embodiments, the case 206 can be located beneath the decking of the first dock section 204-1 to provide for a surface of the decking that is unobstructed. When the case 206 is located beneath the decking of the first dock section 204-1, the decking of the first dock section can be removed to allow for access to the case 206 and/or power source 202.

Alternatively, and/or in addition, an opening can be created in the decking of the first dock section to allow for access to the case 206 without removing an entire portion of decking from the first dock section. In an example, the decking can include an opening that is of a size that can allow a user access to the power source 202 and/or case 206.

In some embodiments, the lid that encloses the case 206 can be configured to fill the opening, such that a surface between the decking of the first dock section 204-1 and the lid that encloses the case 206 is substantially flush. Alternatively, and/or in addition, the opening can be filled by a portion of decking, which can be removed to allow for access to the lid that encloses the case 206.

Alternatively, and/or in addition, the lid that encloses the case 206 can be attached to and/or constructed from a same material that the decking material is made from. Accordingly, the case 206 can be accessed by removing the decking material that is attached to and/or is used to construct the lid.

Some embodiments of the present disclosure can include a first modular lighting group 216-1 configured to attach to the first dock section 204-1. The first modular lighting group 216-1 can include a second electrical connection 250-2 and a third electrical connection 250-3 that are electrically connected. In an example, the second electrical connection 250-2 can be configured to electrically connect to the first electrical connection 250-1 to provide power to the light 218-1 through a light lead 252 that is electrically connected to the light 218-1 and that is included in the first modular lighting group 216-1.

In some embodiments, the first electrical connection 250-1 can be configured to connect directly to the second electrical connection 250-2. Alternatively, and/or in addition, the first electrical connection 250-1 and the second electrical connection 250-2 can be configured to connect via a power lead 254. The power lead 254 can allow for a user to position the power source 202 and/or case 206 at varying distances from the first modular lighting group 216-1. In an example, multiple power leads can be connected to one another to allow for a greater length between the power source 202 and light 218-1. Alternatively, and/or in addition, the power lead 254 can be of a varying length.

In some embodiments, the modular dock lighting system can include a second modular lighting group 216-2 configured to attach to a second dock section 204-2. The second modular lighting group 216-2 can be indirectly connected to the power source 202 with and/or without electrical connectors. In an example, the second modular lighting group 216-2 can be indirectly connected to the power source 202 via the first modular lighting group 216-1.

For instance, the second modular lighting group 216-2 can include a fourth electrical connection 250-4 that can be configured to connect to the third electrical connection 250-3 to provide power to the light 218-2 through a light lead 253 that is electrically connected to the light 218-2 and that is included in the second modular lighting group 216-2.

In some embodiments, the fourth electrical connection 250-4 can be configured to connect directly to the third electrical connection 250-3. Alternatively, and/or in addition, the fourth electrical connection 250-4 and the third electrical connection 250-3 can be configured to connect via an expansion lead 256. The expansion lead 256 can allow for a user to position the first modular lighting group 216-1 at varying distances from the second modular lighting group 216-2. In an example, multiple extension leads 256 can be connected to one another to allow for a greater length. Alternatively, and/or in addition, the extension lead 256 can be of a varying length.

Expansion of the modular lighting groups can alternatively and/or in addition be accomplished through use of a fifth electrical connection 250-5 that is included in the second modular lighting group 216-2. The fifth electrical connection 250-5 can be configured to connect the second modular lighting group 216-2 to a third modular lighting group. Accordingly, the fifth electrical connection 250-5 can be electrically connected to the fourth electrical connection 250-4 via expansion lead 256. The second modular lighting group 216-2 can be configured to connect with the third modular lighting group in a manner analogous to that discussed in relation to how the first modular lighting group 216-1 and the second modular lighting group 216-2 can connect (e.g., expansion lead 258).

In some embodiments, the modular lighting groups 216-1, 216-2 can be directly connected to the power source 202. For example, the first modular lighting group 216-1 can include wiring to directly connect the light 218-1 in the first modular lighting group 216-1 to the power source 202. Alternatively, and/or in addition, the second modular lighting group 216-2 can include wiring to directly connect the light 218-2 in the second modular lighting group 216-2 to the power source 202. In an example, the direct connections between the lights 218-1, 218-2 and the power source 202 can be made with and/or without electrical connectors.

In a manner analogous to that discussed in relation to FIG. 1B, the first modular lighting group 216-1 and the second modular lighting group 216-2 can be adjustable in height and/or laterally adjustable. For example, the first modular lighting group 216-1 and the second modular lighting group 216-2 can be attached to mounts 220-1 and 220-2 that are adjustable in height and/or laterally adjustable.

In some embodiments, the modular dock lighting system can include a second power source 260 (e.g., battery) with a sixth electrical connection 250-6 that can be configured to attach to the second dock section 204-2 and provide an electrical connection to a light 218-3 that is included in a fourth modular lighting group 216-3. The second power source 260 can be contained in a case 262 and the second power source 260 and/or case 262 can be attached to the second dock section in a manner such as that discussed in relation to the first power source 202 and/or case 206.

In an example, the dock can include a number of modular lighting groups and/or lights in a quantity and/or size that can be too large for the power source 202 to provide enough power to each modular lighting group and/or each light to ensure that each modular lighting group and/or each light can produce adequate lighting. For instance, a length of the dock may affect how many lights are attached to the dock. Alternatively, and/or in addition, a density of the lights may affect how many lights are attached to the dock. Accordingly, a second power source 260 can be provided to power a number of the modular lighting groups and/or lights.

For example, the second power source 260 can power a fraction (e.g., one-half) of the modular lighting groups and/or lights attached to the dock. The modular lighting groups and/or lights that are powered by the second power source 260 can be controlled separately from the modular lighting groups and/or lights that are powered by the first power source 202. In an example, a switch can control the first power source 202 and second power source 260 together and/or separately. For instance, power can be turned off to a number of dock sections and/or a side of the dock (e.g., left or right side), while power is left on to a number of dock sections and/or an opposite side of the dock.

In some embodiments, the modular dock lighting system can include a solar panel configured to electrically connect to the power source 202 (e.g., battery). The solar panel can be connected to terminals of the power source 202 and/or can, for example, be connected to the first electrical connection 250-1. For example, the first electrical connection 250-1 can be configured to accept multiple connectors. For instance, the first electrical connection can be configured to accept an electrical connection for the solar panel, an electrical connection for a modular lighting group, and/or an electrical connection for an electrical switch.

The solar panel can be attached to a dock section, for example, an exterior frame member 210-1, 210-2 of the dock, first end frame member 212-1 of the dock, decking of the dock section, and/or a dock post 214. The solar panel can be attached to the dock section via an adjustable mount. By attaching the solar panel to the dock section via the adjustable mount, the solar panel can be adjusted such that solar waves hit the solar panel at a particular angle, which can allow for an increase in solar panel efficiency.

Figure 3:
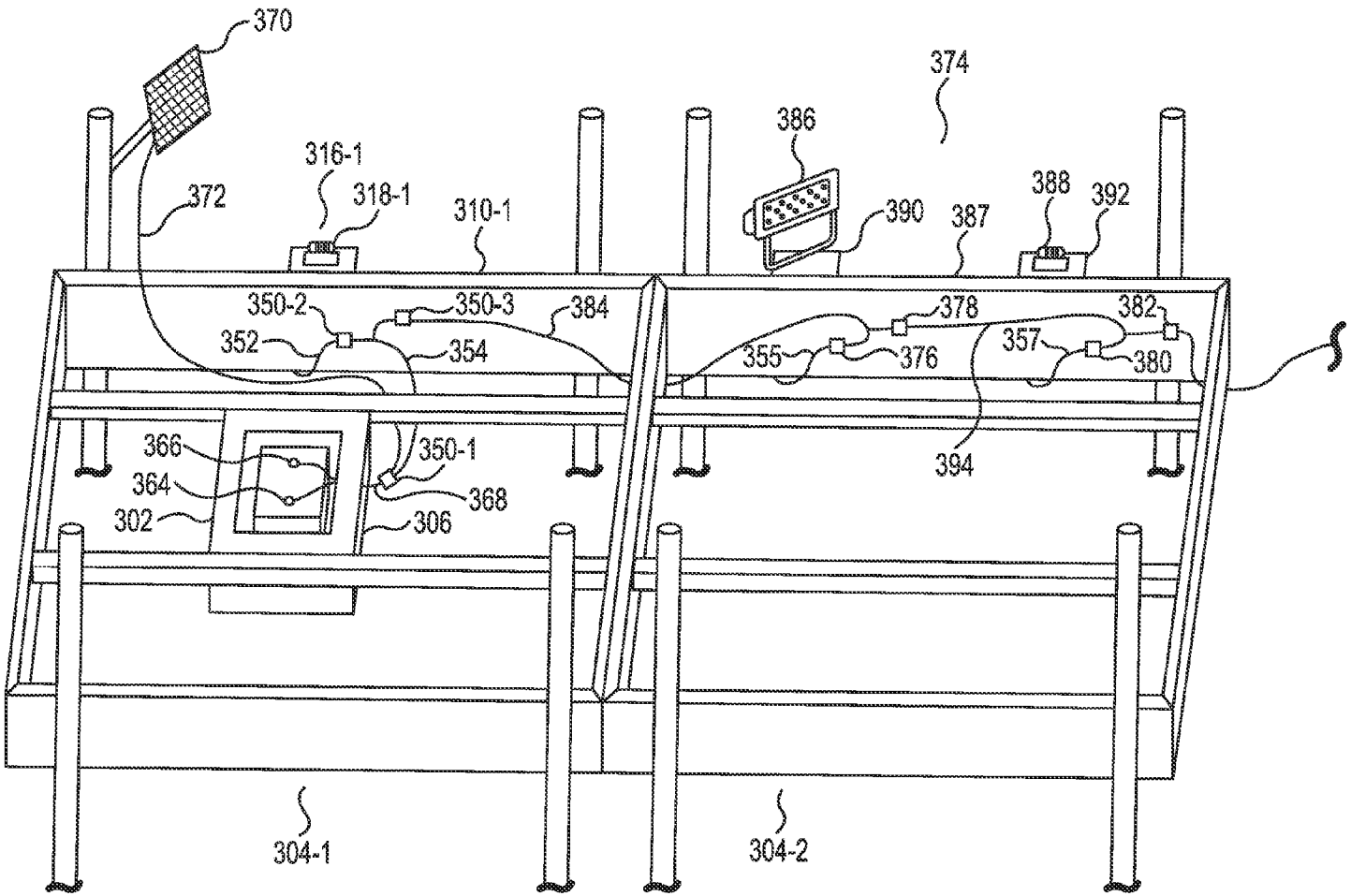
FIG. 3 illustrates a modular dock lighting system according to one or more embodiments of the present disclosure.

FIG. 3 illustrates a modular dock lighting system according to one or more embodiments of the present disclosure. In some embodiments, the modular dock lighting system can include a power source 302 with a first electrical connection 350-1. The power source 302 can be contained in a case 306 attached beneath a decking of a first dock section 304-1.

The power source 302 can be a battery with terminals 364, 366. A terminal lead 368 can be connected to the terminals 364, 366. Alternatively, and/or in addition, the terminal lead 368 can be connected to the first electrical connection 350-1.

In some embodiments, the modular dock lighting system can include a solar panel 370 that can be electrically connected to the first electrical connection 350-1. The solar panel 370 can be electrically connected to the first electrical connection 350-1 via a charging lead 372. Accordingly, the solar panel 370 can charge the power source 302.

In some embodiments, a charging controller can be connected between the solar panel 370 and the power source 302 (e.g., battery). For example, a current produced from the solar panel can pass through the charging controller before reaching the power source 302. The charging controller can prevent the power source 302 (e.g., battery) from being over-charged. The charging controller can be attached to the case 306, power source 302, and/or a frame member of the dock (e.g., 310-1), for example.

In some embodiments, the modular dock lighting system can include a first modular lighting group 316-1 that is attached to a first dock section 304-1. The first modular lighting group 316-1 can include a second electrical connection 350-2 and third electrical connection 350-3 that are electrically connected. In an example, the second electrical connection 350-2 can be configured to electrically connect to the first electrical connection 350-1 via power lead 354 to provide power to the light 318-1 through a light lead 352 that is electrically connected to the light 318-1 and that is included in the first modular lighting group 316-1.

In some embodiments, the modular dock lighting system can include a second modular lighting group 374 attached to a second dock section 304-2. The second modular lighting group 374 can include a fourth electrical connection 376. The fourth electrical connection 376 can be electrically connected to the third electrical connection 350-3 via expansion lead 384 to provide power to the second modular lighting group 374, including a flood light 386, through a light lead 355 that is electrically connected to the flood light 386 and that is included in the second modular lighting group 374.

In some embodiments, the second modular lighting group 374 can include a plurality of lights. For example, the second modular lighting group 374 can include a flood light 386 and/or light 388. The flood light 386 can be used to illuminate the decking of the dock and/or used to illuminate areas surrounding the dock such as a shoreline and/or a boat lift, for example. Light 388 can be used to illuminate the decking of the dock, for example.

The second modular lighting group 374 can include a fifth electrical connection 378, sixth electrical connection 380, and seventh electrical connection 382. The fifth electrical connection 378 can be electrically connected to the fourth electrical connection 376 via expansion lead 394. The fifth electrical connection 378, sixth electrical connection 380, and seventh electrical connection 382 can be electrically connected via expansion lead 394.

The sixth electrical connection 380 can electrically connect lighting lead 357 to the expansion lead 394. Lighting lead 357 can be electrically connected to light 388 to provide power to the light 388 and can be included in the second modular lighting group 374.

Expansion of the modular lighting groups can be accomplished through use of a seventh electrical connection 382 that is included in the second modular lighting group 374. The seventh electrical connection 382 can be configured to connect the second modular lighting group 374 to a third modular lighting group. Accordingly, the seventh electrical connection 382 can be electrically connected to the sixth electrical connection 380 via expansion lead 394. The second modular lighting group 374 can be configured to connect with the third modular lighting group in a manner such as that discussed in relation to how the first modular lighting group 316-1 and the second modular lighting group 374 can connect (e.g., expansion lead 384).

Each of the plurality of lights (e.g., 386, 388) can be attached to a respective height adjustable mount 390, 392. Flood light 386 can be attached to height adjustable mount 390 and/or light 388 can be attached to height adjustable mount 392. Each of the height adjustable mounts 390, 392 can be attached to a frame member 387 of the dock.

In some embodiments, the height adjustable mounts 390, 392 can be laterally adjustable. For example, the adjustable mounts 390, 392 can be attached to a channel included in the frame member 387 of the dock and configured to adjust laterally along the channel, in a manner such as that discussed in relation to FIG. 1B.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A dock lighting system, comprising:

a power source attached at a position located beneath a decking of a first dock section;

a first modular lighting group attached to the first dock section, wherein the first modular lighting group is electrically connected to the power source; and a second modular lighting group attached to a second dock section, wherein the second modular lighting group is electrically connected to the first modular lighting group.

2. The dock lighting system of claim 1, further comprising:

a first connector that electrically connects the power source to a first lead of the first modular lighting group;

a second connector that electrically connects a second lead of the first modular lighting group to a first end of an expansion lead; and a third connector that electrically connects a second end of the expansion lead to a first lead of the second modular lighting group.

3. The dock lighting system of claim 1, further comprising a switch configured to complete an electrical connection between the power source and the first modular lighting group and the second modular lighting group.

4. The dock lighting system of claim 3, wherein the switch is at least one of an optical switch, a motion switch, and a manual switch.

5. The dock lighting system of claim 1, wherein the first modular lighting group and the second modular lighting group are mounted over a decking of the first and second dock section.

6. The dock lighting system of claim 1, wherein each light in the first modular lighting group and each light in the second modular lighting group is attached to a respective adjustable mount, wherein the adjustable mount is attached to an exterior frame member of the dock such that each light in the first and second modular groups directs light over the decking of the dock.

7. The dock lighting system of claim 6, wherein the adjustable mount is configured to provide a vertical adjustment and a lateral adjustment.

8. A modular dock lighting system, comprising:

a power source with a first electrical connection, wherein the power source is configured to attach at a position located beneath a decking of a first dock section;

a first modular lighting group configured to attach to the first dock section, the first modular lighting group including a second and third electrical connection that are electrically connected; wherein the second electrical connection is configured to electrically connect to the first electrical connection;

a second modular lighting group configured to attach to a second dock section, the second modular lighting group including a fourth electrical connection; wherein the fourth electrical connection is configured to connect to the third electrical connection.

9. The modular dock lighting system of claim 8, wherein the power source is configured to attach at a position located beneath a decking of the first dock section.

10. The modular dock lighting system of claim 8, wherein the second modular lighting group includes a fifth electrical connection that is electrically connected to the fourth electrical connection configured to connect the second modular lighting group to a third modular lighting group.

11. The modular dock lighting system of claim 8, further comprising:

a second power source with a sixth electrical connection configured to:

attach to the second dock section; and provide an electrical connection to a fourth modular lighting group.

12. The modular dock lighting system of claim 11, further comprising a case configured to:

contain a battery; and attach to a frame member of a dock section.

13. The modular dock lighting system of claim 12, wherein the case is waterproof.

14. The modular dock lighting system of claim 12, wherein a depth of the case is less than a depth of a frame member of the dock.

15. The modular dock lighting system of claim 11, further comprising a solar panel configured to electrically connect to the battery and attach to a dock section.

16. The modular dock lighting system of claim 8, wherein the first modular lighting group and the second modular lighting group are adjustable in height.

17. The modular dock lighting system of claim 8, wherein the first modular lighting group and the second modular lighting group are laterally adjustable.

18. A modular dock lighting system, comprising:

a power source with a first electrical connection, wherein the power source is contained in a case attached beneath a decking of a first dock section, and wherein the power source is charged through a solar panel electrically connected to the first electrical connection;

a first modular lighting group attached to a first dock section, the first modular lighting group including a second electrical connection and third electrical connection that are electrically connected, wherein the second electrical connection is electrically connected to the first electrical connection; and a second modular lighting group attached to a second dock section, the second modular lighting group including a fourth electrical connection, wherein the fourth electrical connection is electrically connected to the third electrical connection.

19. The modular dock lighting system of claim 18, wherein:

the second modular lighting group includes a plurality of lights;

each of the plurality of lights is attached to a respective height adjustable mount; and each of the height adjustable mounts is attached to a frame member of the dock.

20. The modular dock lighting system of claim 18, further comprising an adjustable mount attached to a channel included in the frame member of the dock and configured to adjust laterally along the channel.

* * * * *